US008286818B2

(12) United States Patent
Suzuki

(10) Patent No.: US 8,286,818 B2
(45) Date of Patent: Oct. 16, 2012

(54) PORTION CONTAINER

(75) Inventor: Kazuo Suzuki, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 172 days.

(21) Appl. No.: 12/865,606

(22) PCT Filed: Jan. 29, 2009

(86) PCT No.: PCT/JP2009/051495

§ 371 (c)(1),
(2), (4) Date: Aug. 23, 2010

(87) PCT Pub. No.: WO2009/096484

PCT Pub. Date: Jun. 8, 2009

(65) Prior Publication Data

US 2010/0320208 A1 Dec. 23, 2010

(30) Foreign Application Priority Data

Jan. 31, 2008 (JP) ..... 2008-021251
Jan. 27, 2009 (JP) ..... 2009-014991

(51) Int. Cl.

| | |
|---|---|
| ***B65D 17/42*** | (2006.01) |
| ***B65D 90/36*** | (2006.01) |
| ***B65D 51/22*** | (2006.01) |
| ***B65D 17/30*** | (2006.01) |
| ***B65D 39/02*** | (2006.01) |

(52) U.S. Cl. ..... 220/277; 220/89.3; 220/258.4; 220/267; 215/297; 222/83; 222/85; 222/281

(58) Field of Classification Search ..... 220/89.2–89.3, 220/258.3–258.4, 266–267, 277; 215/228, 215/295–297; 30/115; 222/80–85, 281
See application file for complete search history.

(56) References Cited

U.S. PATENT DOCUMENTS

| | | | | |
|---|---|---|---|---|
| 2,013,328 | A * | 9/1935 | Wiswell | 222/86 |
| 4,333,581 | A * | 6/1982 | Flansburg | 220/501 |
| 4,953,706 | A * | 9/1990 | Piccard | 220/277 |
| 5,485,938 | A * | 1/1996 | Boersma | 220/714 |
| 7,669,597 | B2 * | 3/2010 | Sullivan et al. | 128/203.21 |

FOREIGN PATENT DOCUMENTS

| | | |
|---|---|---|
| JP | A-2003-095327 | 4/2003 |
| JP | A-2006-248556 | 9/2006 |

OTHER PUBLICATIONS

Aug. 25, 2011 Office Action issued in Chinese Application No. 200980108616.8 (with translation).
International Search Report in International Application No. PCT/JP2009/051495; dated Mar. 3,2009 (with English-langauge translation).

* cited by examiner

*Primary Examiner* — Anthony Stashick
*Assistant Examiner* — Jennifer Castriotta
(74) *Attorney, Agent, or Firm* — Oliff & Berridge, PLC

(57) ABSTRACT

A portion container which can be unsealed easily by an extremely simple operation, and the lid of which can be opened easily with no possibility of scattering of the contents. The container body is constituted of a nonflexible tubular upper structure which is resistant to press deformation, and a flexible bottomed tubular lower structure extending downward from the lower edge of the upper structure and being susceptible to press deformation, wherein a press board connected rotatably with the upper structure and equipped with a cutter is provided vertically in the container. A lid plate is cut by pressing the press board from the outside to rotate the cutter.

9 Claims, 9 Drawing Sheets

PORTION CONTAINER

TECHNICAL FIELD

The present invention relates to a portion container.

BACKGROUND ART

A portion container generally includes a container body having a circumferential wall extending upwards from the periphery of a bottom wall, a flange extending outwards from the upper edge of the circumferential wall, and a lid body having a periphery that is detachably adhered to an upper surface of the flange for tightly closing an upper end opening of the container body.

In this type of known portion container, the lid body is peeled off to dispense the content, so that the lid body is designed so as to be easily peeled off. For example, the flange is partly projected outwards so that the projected part of the lid body forms a non-adhered part free from adhesion to the flange of the portion container, thereby allowing the lid body to be peeled off by holding the non-adhered part. Alternatively, the flange is partly projected outwards and a linear break is formed to extend across the center region of the projected part. The lid body outside the break and the projected part of the flange are firmly adhered to each other, so that upon opening the break is cut off and the lid body is peeled off by holding the cut-off piece outside the break and the adhered part of the lid plate.

In either case, however, improvements have been desired since the content can be splashed out of the container body in an undesirable manner, by a force required for peeling off the lid body. In view of such a problem, there has been proposed a portion container that can be opened without the splash out of the content, as disclosed, e.g., in Document 1.

The proposed portion container is designed to tightly contain the content by a container body and a lid, wherein the container body includes a cup part, a flange on an upper edge of the cup part, and a structural element that can be loaded vertically downwards, wherein the structural element is provided on either the outer surface of the cup part or the lower surface of the flange so that the lid can be detachably adhered to the flange.

Document 1: JP 2006-248556A

DISCLOSURE OF THE INVENTION

Task to be Solved by the Invention

The portion container proposed in Document 1 is designed to prevent splash out of the contained liquid upon peeling off the lid by engaging a nail or the like of the finger with a projection or a groove, thereby fully exhibiting the intended effect. However, the engagement of the nail with a small projection or groove is very annoying, with the result that only a person skillful with his/her finger can operate the portion container well.

The present invention has been achieved in view of such a problem, and provides an improved portion container wherein the lid can be readily opened by an easy operation without causing splash out of the content.

Means for Solving the Task

A first aspect of the present invention resides in a portion container, which comprises: a container body including an inflexible, cylindrical upper part forming section, which is hardly press-deformable, and a flexible lower part forming section, which is readily press-deformable, said lower part forming section extending from a lower edge of the upper part forming section and having a cylindrical form with a closed bottom; at least one pressure plate having an upper edge hinge-coupled to the upper part forming section and being suspended vertically downwards within the container body; at least one cutter projecting from said at least one pressure plate; and a lid plate having a periphery fixedly attached to the upper surface of the container body to close an upper end opening of the container body, said lid plate being adapted to be broken by pressing the pressure plate inwards from outside of the lower part forming section and thereby causing said at least one cutter to be moved toward the lid plate.

A second aspect of the present invention resides in a portion container according to the first aspect, which further comprising a finger touch plate suspended within the container body from the lower edge of the upper part forming section, said finger touch plate being located in a position opposite to the pressure plate.

A third aspect of the present invention resides in a portion container according to the first aspect, wherein a pair of said pressure plate is located in mutually opposite positions, and a plurality of said cutter is provided in at least one position on each of the pressure plates, respectively.

A fourth aspect of the present invention resides in a portion container according to the third aspect, wherein said pair of pressure plates comprises a first pressure plate, and a second pressure plate opposed to the first pressure plate, and said plurality of cutters comprises a first cutter extending toward the center from an intermediate region of an upper part of the first pressure plate, and a second cutter as well as a third cutter extending on both sides of the first cutter from both side regions of an upper part of the second pressure plate, respectively.

A fifth aspect of the present invention resides in a portion container according to the any one of the first to the fourth aspect, wherein said at least one cutter comprises a support plate extending toward the center of the container from the upper part of the pressure plate, and a blade projecting perpendicularly from a tip end of the support plate.

A sixth aspect of the present invention resides in a portion container according to the any one of the first to the fifth aspect, wherein the blade provided on the cutter has a tip with a substantially conical shape.

A seventh aspect of the present invention resides in a portion container according to the any one of the first to the sixth aspect, wherein the pressure plate is formed as an arcuate plate that is curved to project toward the center of the container.

An eighth aspect of the present invention resides in a portion container according to the any one of the first to the seventh aspect, which comprises: a first member, in which said upper part forming section, said at least one pressure plate and said at least one cutter are integrally molded from a synthetic resin; and a second member having an upper edge of a cylindrical shape with a closed bottom, and made of a synthetic resin, said second member being fixedly attached to an outer circumference of the upper part forming section to form an integral container body.

EFFECTS OF THE INVENTION

The portion container according to the present invention provides a unique technical effect that it can be opened by an easy operation, such as trapping gripping and pressing the container body in its inverted state, and dispensing the content into another container without causing undesirable splash out of the content.

The pressure plate can be easily pressed inwards, if a finger touch plate is suspended within a container body from the lower end of the upper part fowling section, which is located in a position opposed to the pressure plate.

If the portion container is designed to include a pair of pressure plates that are located in mutually opposed positions and a cutter is provided in at least one position on each pressure plate, respectively, a more extensive cutting region can be obtained, thereby allowing the content to be dispensed into another container much easier in short a time.

Similarly, the content can be easily dispensed into another container and the lid plate of the portion container with a relatively small area can be effectively broken, if the pressure plates are comprised of a first pressure plate and a second pressure plate opposed to the first pressure plate, and the cutters are comprised of a first cutter extending toward the center from an intermediate region in the upper part of the first pressure plate, and a second cutter as well as a third cutter extending on both sides of the first cutter from both side regions of an upper part forming section of the second pressure plate, respectively.

If the cutter comprises a support plate extending toward the center from the upper part of the pressure plate, and a blade projecting perpendicularly from a tip end of the support plate, the lid plate firstly cut by the blade can be further extensively cut open with the support plate, thereby allowing the lid plate to be widely cut in two dimensional directions.

If the blade provided on the cutter is provided with a tip having a substantially conical shape, the lid plate can be easily cut due to the sharp shape of the tip.

If the pressure plate is formed as an arcuate plate that is curved toward the center of the container, a pressing finger can be readily fit to the pressure plate thereby allowing the movement of the finger to readily follow the movement of the pressure plate.

Production of the portion container can be advantageously simplified and the cost reduced, if the portion container comprises: a first member, in which said upper part forming section, said at least one pressure plate and said at least one cutter are integrally molded from a synthetic resin; and a second member having an upper edge of a cylindrical shape with a closed bottom, and made of a synthetic resin, said second member being fixedly attached to an outer circumference of the upper part forming section to form an integral container body.

REFERENCE SYMBOLS

Figure 1:
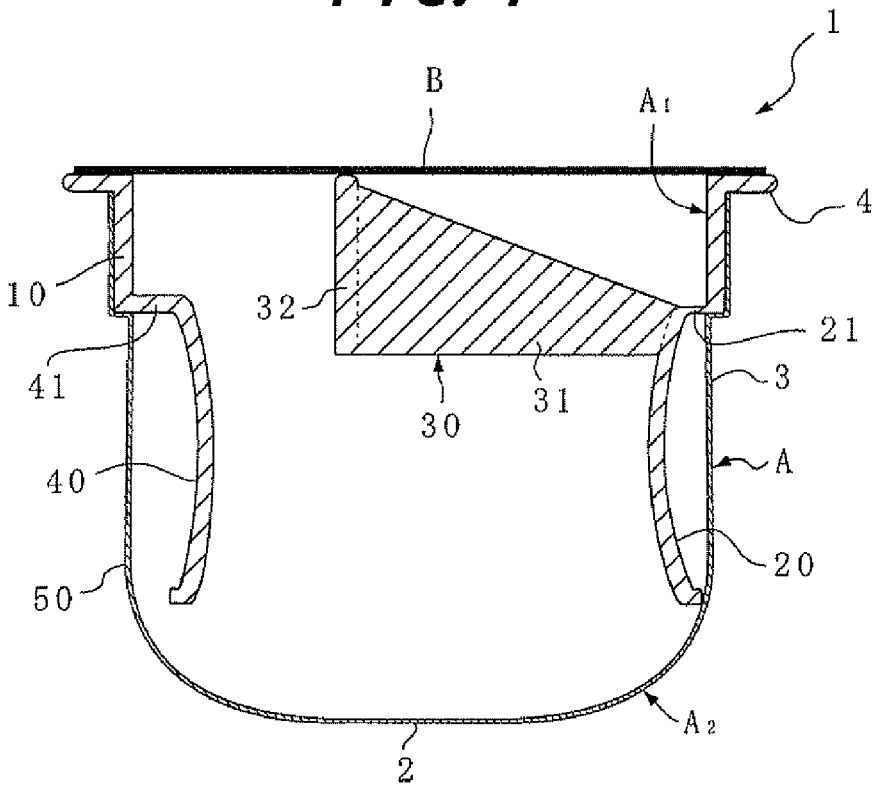
FIG. 1 is a longitudinal sectional view of a portion container according a first embodiment of the present invention.
Figure 2:
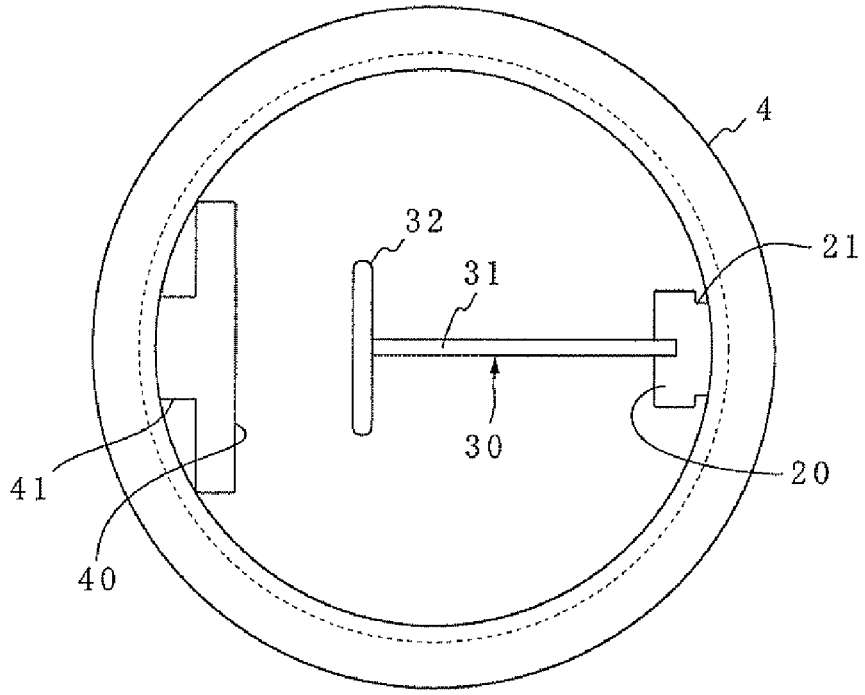
FIG. 2 is a plan view of the portion container before attachment of the lid plate in the first embodiment.
Figure 3:
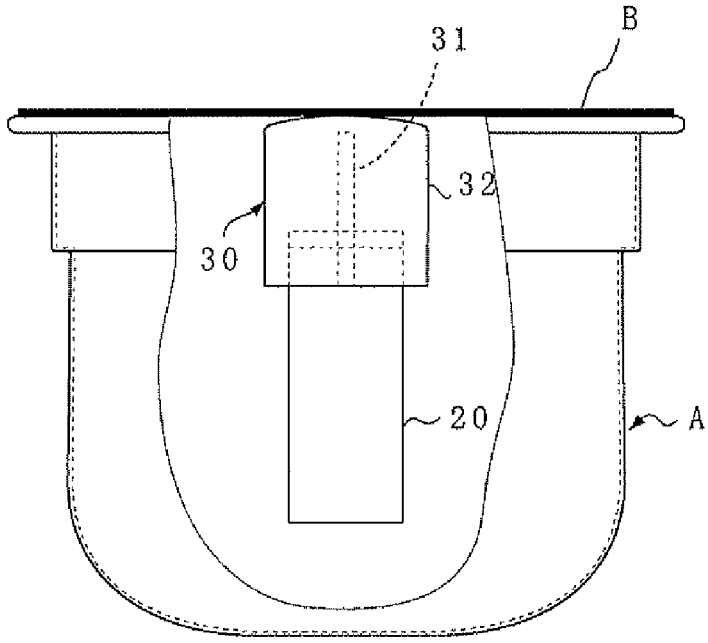
FIG. 3 is a partially cut out side view of the portion container according to the first embodiment.

A Container body
A1 First member
A2 Second member
B Lid plate
1 Portion container
2 Bottom wall
3 Circumferential wall
4 Flange
10 Upper part forming section
20 Pressure plates
20*a* First pressure plate
20*b* Second pressure plate
21 Hinges
21*a* First hinge
21*b* Second hinge
30 Cutters
30*a* First cutter
30*b* Second cutter
30*c* Third cutter
31 Support plates
31*a* First support plate
31*b* Second support plate
31*c* Third support plate
32 Blades
32*a* First blade
32*b* Second blade
32*c* Third blade
33 Angle sections
33*a* Angle section with a tip at the center
33*b* Angle section with an eccentric tip
40 Finger touch plate
41 Coupling plate
50 Lower part forming section

BEST MODE FOR CARRYING OUT THE INVENTION

Some embodiments of the present invention will be described below with reference to the accompanying drawings.

First Embodiment

A first embodiment of the portion container 1 according to the present invention is shown in FIG. 1 to FIG. 4, and includes a container body A and a lid plate B. The container body A has a cylindrical shape with a closed bottom and an open upper end, a circumferential wall 3 extending upwards from periphery of a bottom wall 2, and a flange 4 extending outwards from the upper edge of the circumferential wall 3.

In the illustrated embodiment, the container body A comprises a first member A1 and a second member A2.

The first member A1 is made of a synthetic resin and inflexible so as to be hardly press-deformable. The first member A1 comprises a cylindrical upper part forming section 10 that includes an upper part of the circumferential wall 3 and the flange 4, as an upper part of the container body A, as well as a pressure plate 20, a cutter 30 and a finger touch plate 40.

The second member A2 is made of a synthetic resin and flexible so as to be readily press-deformable. The second member A2 has a cylindrical shape with a closed bottom, and an upper end fixedly attached to an outer circumference of the upper part forming section 10, and a cylindrical lower part forming section 50 with a closed bottom that extends downward from a lower end of the upper part forming section 10 to thereby form the container body A comprised of the upper part forming section 10 and the lower part forming section 50.

The pressure plate 20 is in the form of a strip-like arcuate plate curved inwards toward the center of the container body, and being suspended vertically downwards within the container body A, with its upper edge coupled to a part of the lower edge of the upper member A1. The upper edge of the pressure plate 20 and the lower edge of the upper part forming section 10 are integrally connected through a flexible plate-like hinge 21. Thus, when the pressure plate 20 is pressed and bent inwards, the pressure plate 20 is caused to move about the hinge 21 toward the lid plate B.

The cutter 30 is formed integrally with the pressure plate 20, projecting inwards from the pressure plate 20 and designed to break the lid plate B as it is moved following the movement of the pressure plate 20. The cutter 30 is comprised of a support plate 31 extending from the center in the upper face of the pressure plate 20, and having an upper face inclined upwards in the projected direction of the cutter 30. A plate-like blade 32 extends perpendicularly from the support plate 31 on the tip of the support plate 31. The support plate 31 extends with a projection length slightly larger than the radius of the container body A.

The finger touch plate 40 is formed as an arcuate plate, which is curved inwards and suspended vertically downwards within the container body A. The finger touch plate 40 has an upper end, which is integrally connected to a tip of a coupling plate 41 to project inwards from the lower edge of the upper part forming section 10 located in a position opposed to the pressure plate 20.

The lid plate B has a periphery that is fixedly attached to the upper face of the container body A, for tightly closing the opening on the upper end of the container body A. The lid plate B may be made of a single layer of synthetic resin film or sheet, multiple-layered synthetic resin films or sheets, or multiple-layered films or sheets of synthetic resin and metal. Any appropriate attachment means may be applied, such as welding or adhesion, for the fixed attachment of the lid plate B to the container body A.

Figure 4:
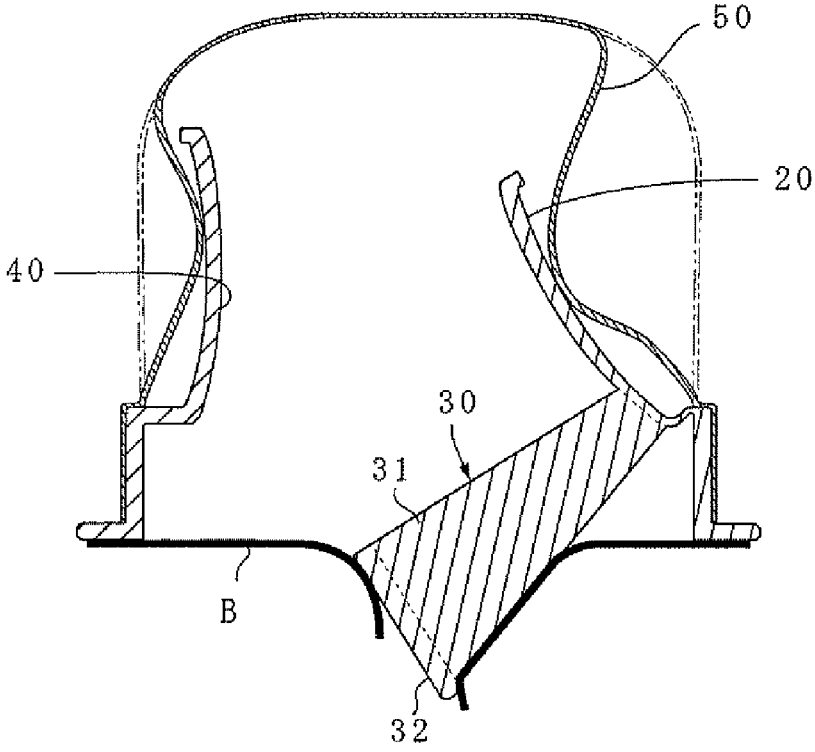
FIG. 4 shows the manner of using the portion container according to the first embodiment.

Now, there is explained the manner of using the portion container according to the first embodiment described above. Starting from the state shown in FIG. 1, the portion container 1 is inverted and held by two fingers so that the lower part forming section 50 is pressed inwards from both sides. In this instance, one of the fingers is rested on the finger touch plate 40 and the pressure plate 20 is moved inwards by the other finger, resulting in the cutter 30 being moved as shown in FIG. 4. As a result, the lid plate B is cut by the blade 32 thereby allowing the content to be dispensed.

Second Embodiment

Figure 5:
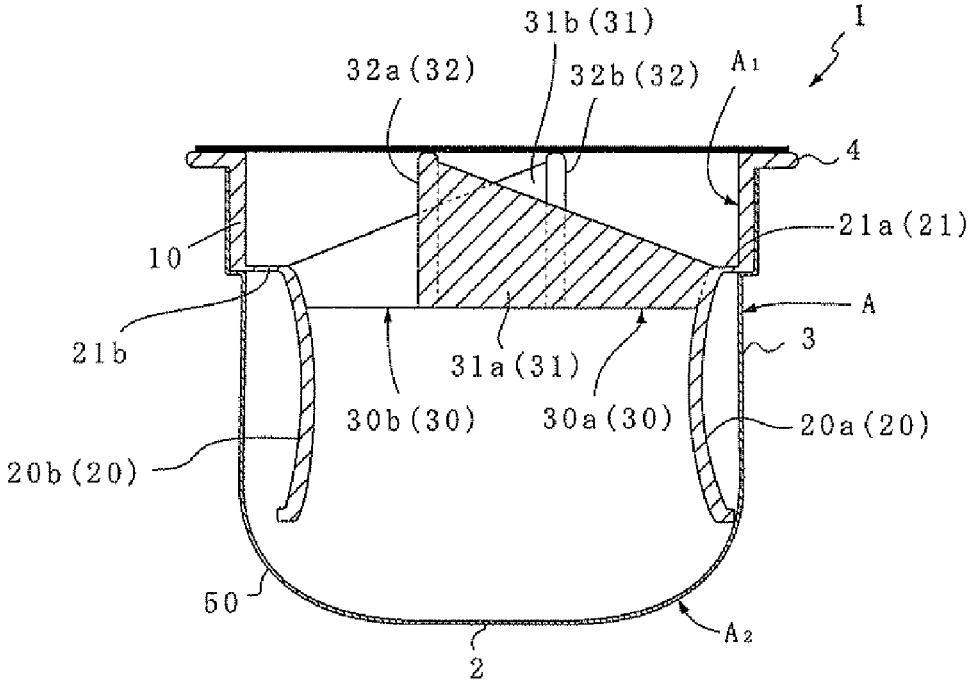
FIG. 5 is a longitudinal sectional view according to a second embodiment of the invention.
Figure 6:
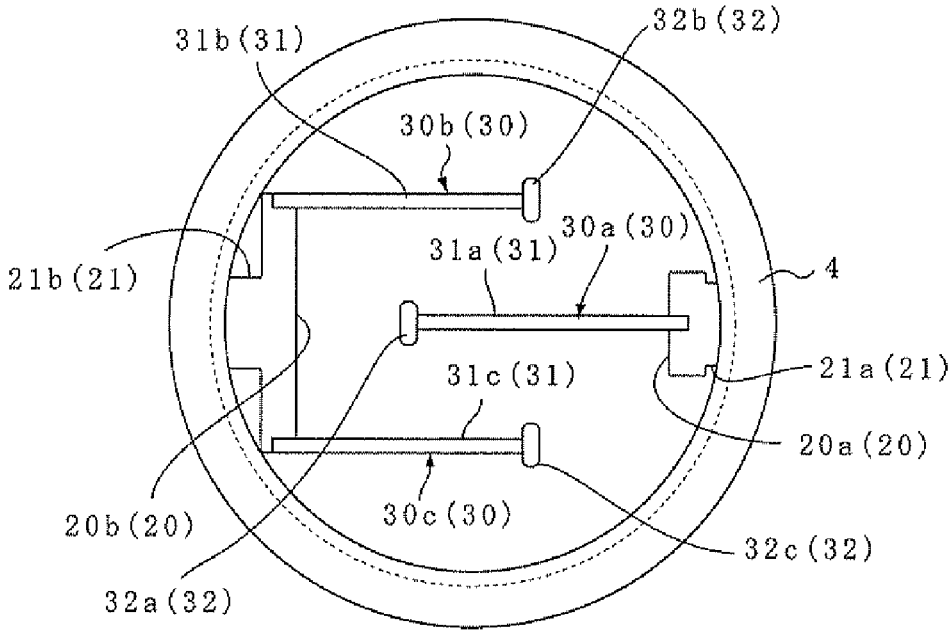
FIG. 6 is a plan view of the portion container before attachment of the lid plate in the second embodiment.
Figure 7:
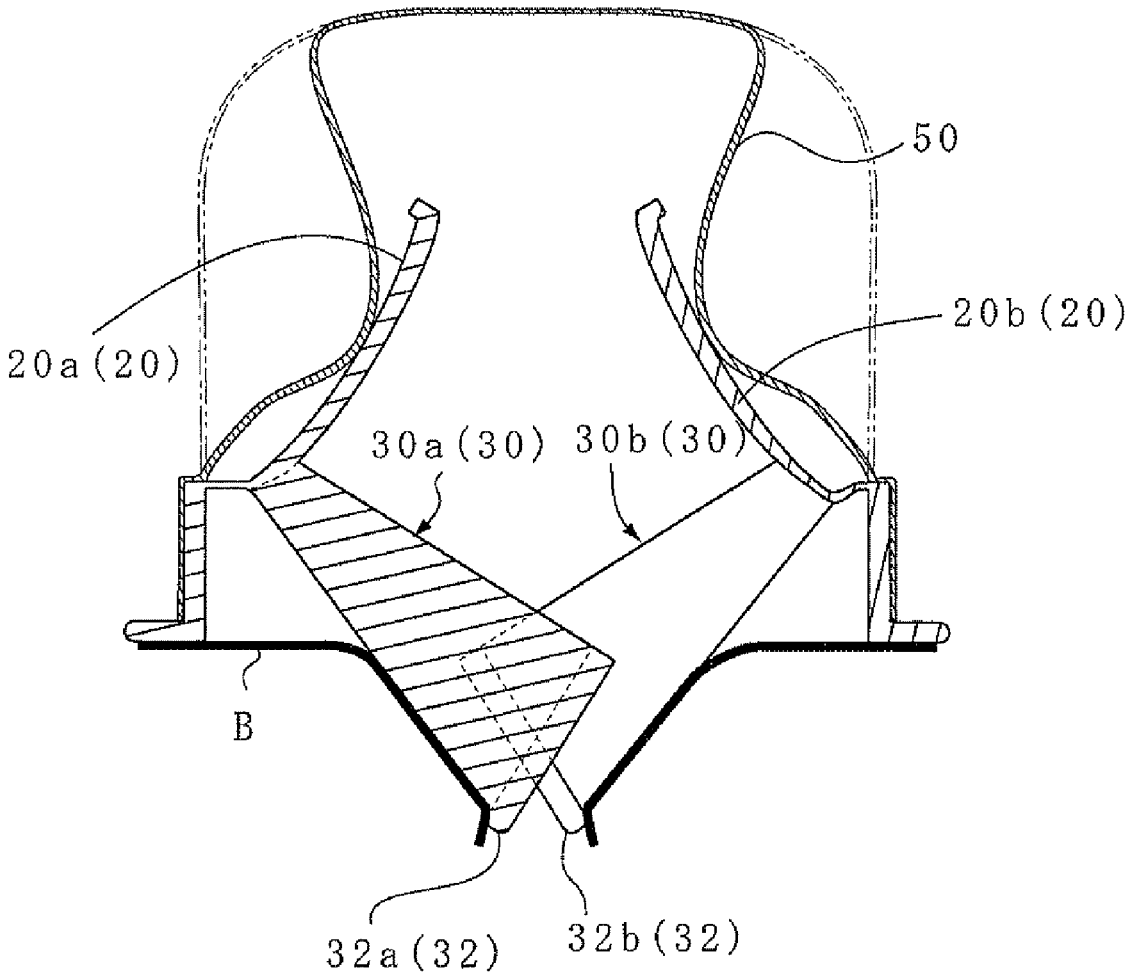
FIG. 7 shows the manner of using the portion container according to the second embodiment.
Figure 8:
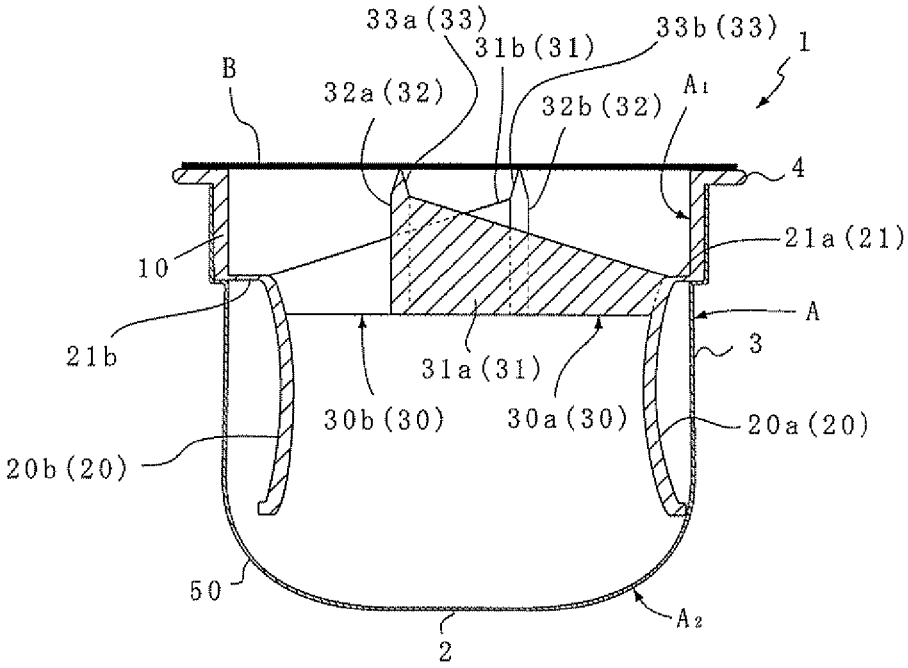
FIG. 8 is a longitudinal sectional view according to a third embodiment of the invention.
Figure 9:
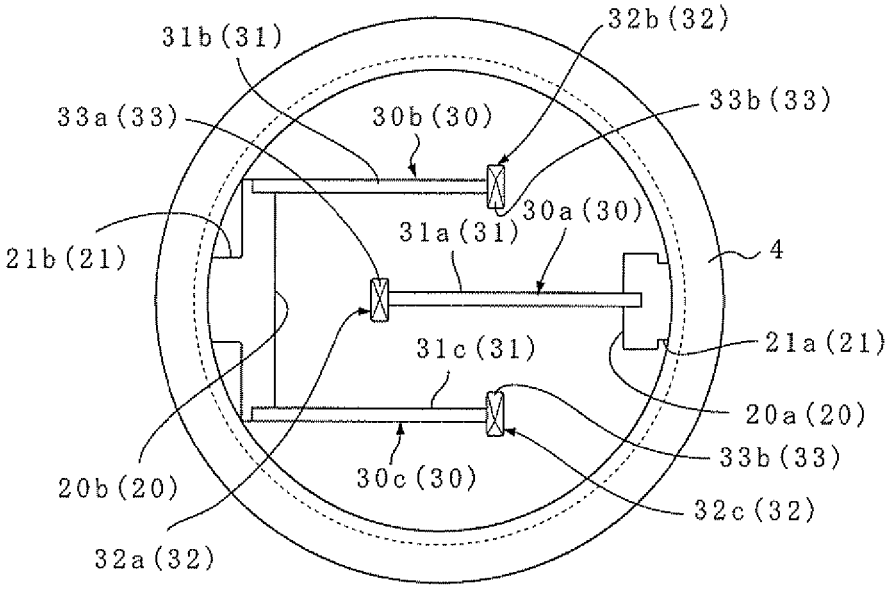
FIG. 9 is a plan view of the portion container before attachment of the lid plate in the third embodiment.
Figure 10:
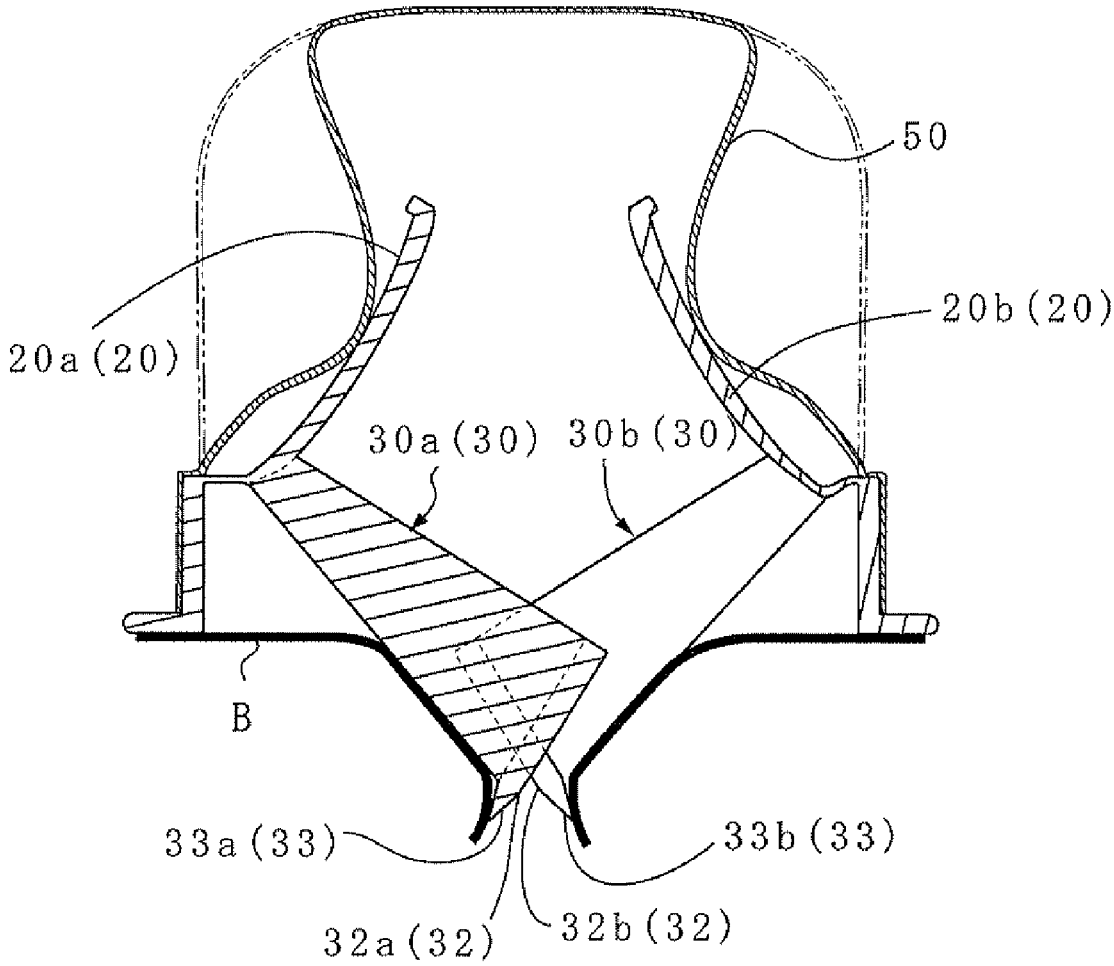
FIG. 10 shows the manner of using the portion container according to the third embodiment.

A second embodiment of the portion container is shown in FIG. 5 to FIG. 7, which includes a pair of pressure plate 20 and a plurality of cutters 30.

The first member A1 is made of synthetic resin and inflexible so as to be hardly press-deformable. The first member A1 is comprised of the upper part forming section 10 including an upper part of the circumferential wall 3 and the flange 4, as an upper part of the container body A, as well as a first pressure plate 20*a* with a first cutter 30*a*, and a second pressure plate 20*b* with a second cutter 30*b* and a third cutter 40*b*.

The second member A2 is made of synthetic resin and flexible so as to be readily press-deformable, in a similar manner as the embodiment of FIG. 1. The second member A2 has a cylindrical shape with a closed bottom, and an upper end fixedly attached to the outer circumference of the upper part forming section 10, and a cylindrical lower part forming section 50 with a closed bottom that extends downward from the lower edge of the upper part forming section 10 to thereby form the container body A.

The pressure plate 20*a* is in the form of a strip-like arcuate plate curved toward the center of the container body A, and being suspended vertically downwards within the container body A, with its upper edge coupled to a part of the lower edge of the upper member A1. The upper edge of the pressure plate 20*a* and the lower edge of the upper part forming section 10 are integrally connected by a flexible plate-like first hinge 21*a*. When a part of the pressure plate 20*a* is bent inwards about the hinge 21*a*, the pressure plate 20*a* is moved upwards toward the lid plate.

The cutter 30*a* is formed integrally with the pressure plate 20*a*, projecting inwards from the pressure plate 20*a* and designed to break the lid plate as it is moved following the movement of the pressure plate 20*a*. The cutter 30*a* is comprised of a first support plate 31*a* extending from the center in the upper face of the pressure plate 20*a* toward the center of the container body, and having an upper face inclined upwards in the projected direction of the cutter 30*a*. A plate-like blade 32*a* extends perpendicularly from the support plate 31*a* on the tip of the support plate 31*a*. The support plate 31*a* extends with a projection length slightly larger than the radius of the container body A.

Similarly, the pressure plate 20*b* is in the form of a strip-like arcuate plate curved toward the center of the container body, and being suspended vertically downwards within the container body A, with its upper edge coupled to a part of the lower edge of the upper member A1. The upper edge of the pressure plate 20*b* and the lower edge of the upper part forming section 10 are integrally connected by a flexible plate-like hinge 21*b*. Thus, when the pressure plate 20*b* is pressed and bent inwards, the pressure plate 20*b* is caused to move about the hinge 21*b* toward the lid plate B. The second pressure plate 20*b* is wider than the first pressure plate 20*a*, since it includes two cutters 30, i.e., a second cutter 30*b* and a third cutter 30*c*.

The second cutter 30*b* and the third cutter 30*c* are formed integrally with the pressure plate 20*b*, projecting inwards from the pressure plate 20*b* and designed to break the lid plate as they are moved following the movement of the pressure plate 20*b*. The cutters 30*b* and 30*c* are comprised of a second support plate 31*b* and a third support plate 31*c* extending inwards from an upper part of the inner face of the pressure plate 20*b* on both sides of the first cutter 30*a*, and having upper faces inclined upwards, respectively. A second plate-like blade 32*b* and a third plate-like blade 32*c* extend perpendicularly from the first support plate 31*b* and the second support plate 31*c* on the tips of the respective support plates. The second support plate 31*b* and the third support plate 31*c* also extend with a slightly larger length than the radius of the container body A.

Now, there is explained the manner of using the portion container according to the second embodiment described above. Starting from the state shown in FIG. 5, the portion container 1 is inverted and held by two fingers so that the lower part fanning section 50 is pressed inwards from both sides. In this instance, the first pressure plate 20*a* is moved inwards by one of the fingers, while the second pressure plate 20*b* is moved inwards by the other finger. As a result, the first cutter 30*a*, the second cutter 30*b* and the third cutter 30*c* are each moved as shown in FIG. 7, so that the lid plate B is cut by the first blade 32*a*, the second blade 32*b* and the third blade 32*c* thereby allowing the content to be dispensed.

Third Embodiment

A third embodiment of the portion container is shown in FIG. 8 to FIG. 13, wherein the tip of the blade 32 in the second embodiment of FIG. 5 is modified as a substantially conical angle section 33. "Substantially conical" as used herein includes a general conical form as well as a conical form, wherein the tip of a general cone is laterally dislocated.

Figure 11:
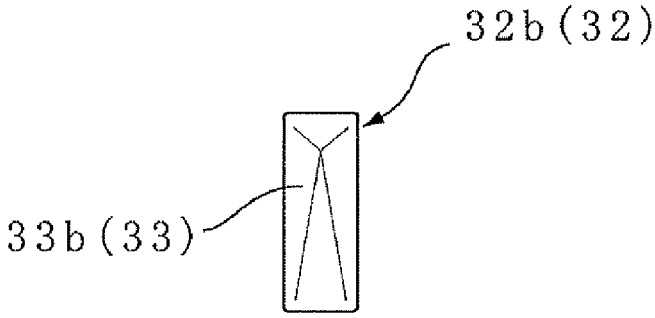
FIG. 11 is an enlarged plan view showing a tip of a blade in the third embodiment.
Figure 12:
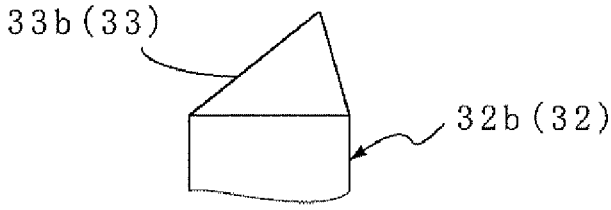
FIG. 12 is an enlarged side view showing the tip of the blade in the third embodiment.
Figure 13:
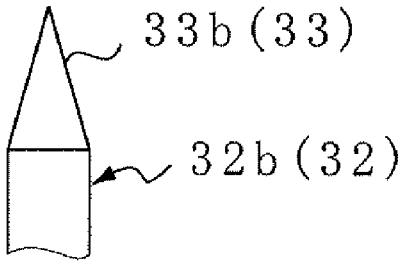
FIG. 13 is an enlarged front view showing the tip of the blade in the third embodiment.

In this case, the angle section 33 of the first blade 32*a* is an angle section 33*a* in the form of a quadrangular pyramid having its tip centrally located, while the angular section 33 of the second blade 32*b* and the third blade 32*c* are angle sections 33*b* in the form of a quadrangular pyramid having its tip eccentrically located in an outward direction of the first support plate 31*a*. FIG. 11 to FIG. 13 are enlarged views of the angle section 33*b* of the second blade 32*b*, respectively. Since the configuration is otherwise similar to that of the second embodiment of FIG. 5, a superfluous description is omitted for the sake of simplicity, denoting the corresponding elements with the same reference symbols. An advantageous effect of the third embodiment is that a more extensive cutting region can be obtained by the second cutter 30*b* and the third cutter 30*c*.

Fourth Embodiment

Figure 14:
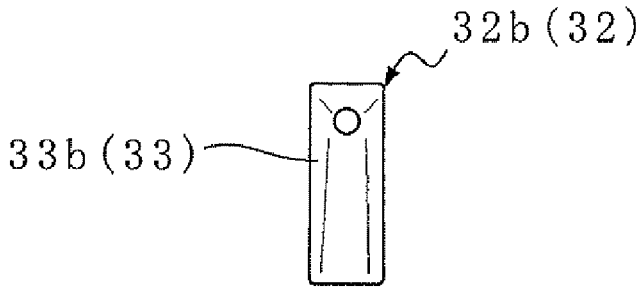
FIG. 14 is an enlarged plan view showing the tip of the blade in a fourth embodiment of the invention.
Figure 15:
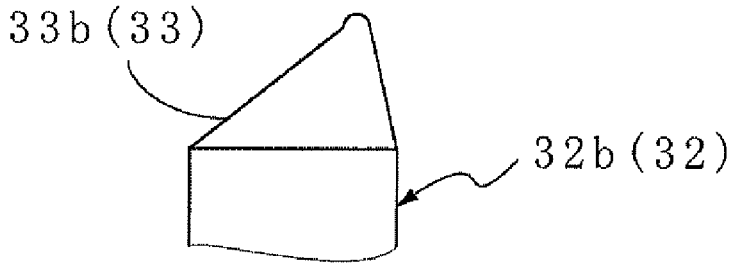
FIG. 15 is an enlarged side view showing the tip of the blade in the fourth embodiment of the invention.
Figure 16:
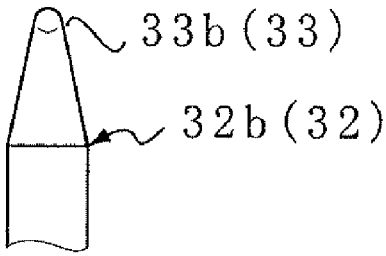
FIG. 16 is another enlarged plan view showing a tip of a blade according to the fourth embodiment of the invention.

Although an example of the angle section 33 with a sharp tip has been described and shown with reference to the third embodiment, this is not a limitation. Thus, the tip of the angle section may be formed into a miniature hemispherical shape as shown with respect to the angle section 33*b* of the second blade 32*b* in the enlarged views of FIGS. 14 to 16. Such an arrangement is of course applicable to the angle section 33*a* with a tip that is centrally located, and provides an advantageous effect of positively preventing human injury, which could be otherwise caused when a user touches the angle section 33 by a finger and the like by mistake, after cutting the lid. Although an example of quadrangular pyramid has been described above and shown in the drawings, other geometrical pyramids with a circular cross-section, oval cross-section or polygonal cross-section may be adopted. Furthermore, the tip of the angle section 33 may be either centrally or eccentrically located for all the cutters. These configurations may be also applicable to the first embodiment of FIG. 1.

Fifth Embodiment

Figure 17:
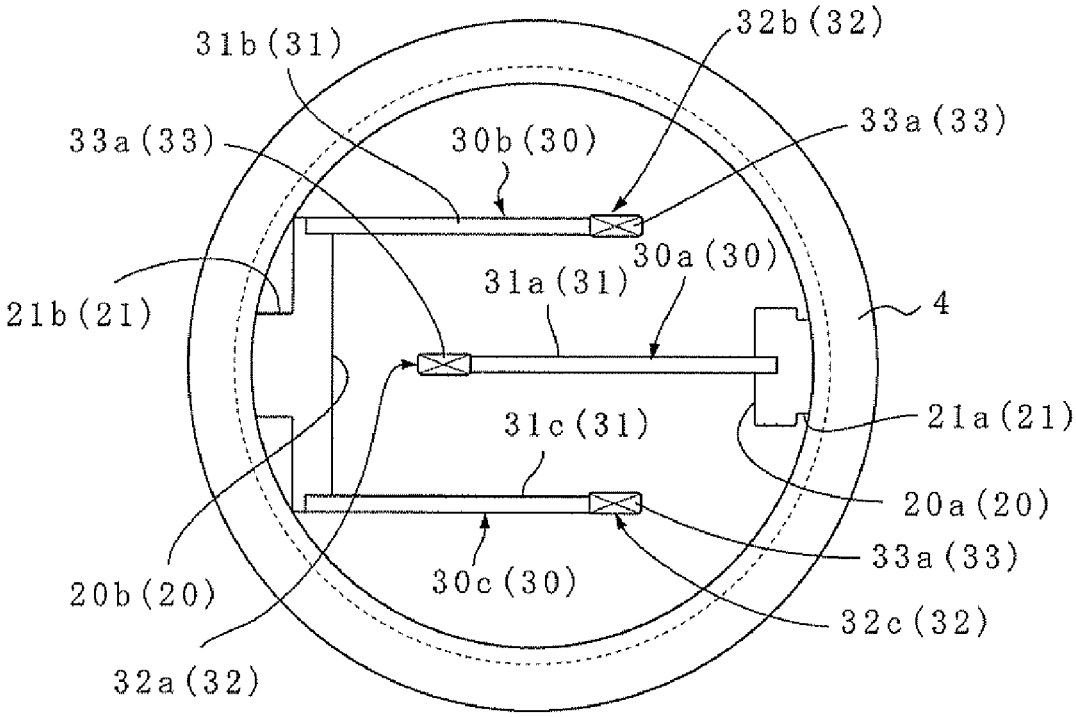
FIG. 17 is a plan view of the portion container before attachment of the lid plate, according to a fifth embodiment of the invention.

FIG. 17 shows a fifth embodiment as a variation of the third embodiment of FIG. 8 to FIG. 13, in which the first to third cutters 30*a*-30*c* each extends from the tip of the support plate 31 in the same direction as the support plate 31. In this case, the angle section 33*a* is designed so that the tip of the first to third blades 32*a* to 32*c* is centrally located. Since the configuration is otherwise similar to that of the third embodiment of FIG. 8, a superfluous description is omitted for the sake of simplicity, denoting the corresponding elements with the same reference symbols.

While in the above embodiments the container body A has been described as being formed of a synthetic resin, the container body A may be formed of a film or sheet of a suitable metal, such as aluminum or the like.

The invention claimed is:

1. A portion container comprising:

a container body including an inflexible, cylindrical upper part forming section, which is hardly press-deformable, and a flexible lower part forming section, which is readily press-deformable, said lower part forming section extending from a lower edge of the upper part forming section and having a cylindrical form with a closed bottom;

at least one pressure plate having an upper edge hinge-coupled to the upper part forming section and being suspended vertically downwards within the container body;

at least one cutter projecting from said at least one pressure plate; and a lid plate having a periphery fixedly attached to the upper surface of the container body to close an upper end opening of the container body, said lid plate being adapted to be broken by pressing the pressure plate inwards from outside of the lower part forming section and thereby causing said at least one cutter to be moved toward the lid plate.

2. The portion container according to claim 1, further comprising a finger touch plate suspended within the container body from the lower edge of the upper part forming section, said finger touch plate being located in a position opposite to the pressure plate, the finger touch plate configured to maintain its orientation relative to the upper part forming section when pressed from outside of the lower part forming section.

3. The portion container according to claim 1, wherein a pair of said pressure plates are located in mutually opposite positions, and a plurality of said cutters are provided in at least one position on each of the pressure plates, respectively.

4. The portion container according to claim 3, wherein said pair of pressure plates comprises a first pressure plate, and a second pressure plate opposed to the first pressure plate, and said plurality of cutters comprises a first cutter extending toward the center from an intermediate region of an upper part of the first pressure plate, and a second cutter as well as a third cutter extending on both sides of the first cutter from both side regions of an upper part of the second pressure plate, respectively.

5. The portion container according to claim 1, wherein said at least one cutter comprises a support plate extending toward the center of the container from the upper part of the pressure plate, and a blade projecting perpendicularly from a tip end of the support plate.

6. The portion container according to claim 1, wherein the blade provided on the cutter has a tip with a substantially conical shape.

7. The portion container according to claim 1, wherein the pressure plate is formed as an arcuate plate that is curved to project toward the center of the container.

8. The portion container according to claim 1, comprising:

a first member, in which said upper part forming section, said at least one pressure plate and said at least one cutter are integrally molded from a synthetic resin; and a second member having an upper edge of a cylindrical shape with a closed bottom, and made of a synthetic resin, said second member being fixedly attached to an outer circumference of the upper part forming section to form an integral container body.

9. The portion container according to claim 1, wherein the upper part forming section is hardly press-deformable with a human hand and the lower part forming section is readily press-deformable with a human hand.

* * * * *